US012429314B2

(12) United States Patent
Daley, Jr.

(10) Patent No.: US 12,429,314 B2
(45) Date of Patent: Sep. 30, 2025

(54) ADJUSTABLE ANGLE THREE-DIMENSIONAL TARGET STAND

(71) Applicant: Kenneth R. Daley, Jr., Parkersburg, WV (US)

(72) Inventor: Kenneth R. Daley, Jr., Parkersburg, WV (US)

( * ) Notice: Subject to any disclaimer, the term of this patent is extended or adjusted under 35 U.S.C. 154(b) by 519 days.

(21) Appl. No.: 18/093,028

(22) Filed: Jan. 4, 2023

(65) Prior Publication Data

US 2024/0219154 A1 Jul. 4, 2024

(51) Int. Cl.
*F41J 1/10* (2006.01)
*F41J 3/00* (2006.01)

(52) U.S. Cl.
CPC ..... *F41J 1/10* (2013.01); *F41J 3/0004* (2013.01)

(58) Field of Classification Search
CPC ..... F41J 3/0004; F41J 1/10
USPC ..... 273/406–408
See application file for complete search history.

(56) References Cited

U.S. PATENT DOCUMENTS 906,392 A * 12/1908 Dietz ..... F41G 3/26 434/11
4,629,188 A * 12/1986 Mahieu ..... A63B 63/00 473/454
5,676,378 A * 10/1997 West ..... F41J 1/10 273/390
5,829,753 A * 11/1998 Wiser ..... F41J 1/10 273/407
5,906,552 A * 5/1999 Padilla ..... A63B 69/0097 473/421
5,967,523 A * 10/1999 Brownlee ..... F41J 1/10 273/407
6,550,773 B2 4/2003 McKenzie et al.
7,744,090 B1 6/2010 Nettle
8,091,895 B2 1/2012 Allen
8,505,921 B2 * 8/2013 Amodt ..... F41J 1/10 273/407
8,938,905 B1 * 1/2015 Moore ..... A01M 31/008 239/57
8,960,677 B2 2/2015 Mickelson et al.
9,651,342 B2 5/2017 Johnson
9,797,694 B1 * 10/2017 Cummins ..... F41J 1/10
9,829,285 B1 * 11/2017 Kimblad ..... F41J 7/06
9,915,507 B1 * 3/2018 Cummins ..... F41J 1/10
2007/0045965 A1 * 3/2007 Bateman ..... F41J 1/10 273/407

(Continued)

FOREIGN PATENT DOCUMENTS

SE 500154 C2 * 4/1994 ..... F41J 7/04

*Primary Examiner* — Morgan T Jordan
(74) *Attorney, Agent, or Firm* — William P. Smith

(57) ABSTRACT

A target stand for various archery and shooting targets, and more specifically to an adjustable angle three-dimensional target stand. An upright member assembly for mounting an archery target. The upright member includes a peg connected to a peg base. The peg base has an upper aperture and a pivot aperture. The peg based attached to at least one dial plate by a pivot bolt inserted through the pivot aperture. The peg base may be pivoted about the pivot bolt to adjust an angular position of the peg. Fore and rear legs of a target body resembling a game animal are mounted on a pair of upright members that are connected to an adjustment arm for setting the separation of the upright arms to correspond with the target body fore and rear legs.

20 Claims, 3 Drawing Sheets

(56) References Cited

U.S. PATENT DOCUMENTS

| | | | | |
|---|---|---|---|---|
| 2007/0074412 | A1* | 4/2007 | Kahute | F41J 1/10 33/293 |
| 2009/0020955 | A1* | 1/2009 | Marshall | F41J 1/10 273/404 |
| 2009/0295094 | A1* | 12/2009 | Duerr | F41J 3/0004 273/348 |
| 2010/0194048 | A1* | 8/2010 | Medina | F41J 1/10 273/407 |
| 2011/0175293 | A1* | 7/2011 | Brune | F41J 7/04 273/406 |
| 2014/0091190 | A1* | 4/2014 | Argo | F41B 5/1453 248/397 |
| 2015/0184984 | A1* | 7/2015 | Johnson | F41J 1/10 273/359 |
| 2015/0268013 | A1* | 9/2015 | Heise | F41J 7/04 273/389 |
| 2016/0265885 | A1* | 9/2016 | Logan | F41J 1/10 |
| 2024/0219154 | A1* | 7/2024 | Daley, Jr. | F41J 3/0004 |

* cited by examiner

ADJUSTABLE ANGLE THREE-DIMENSIONAL TARGET STAND

BACKGROUND OF THE INVENTION

The application generally relates to a target stand for various archery and shooting targets. The application relates more specifically to an adjustable angle three-dimensional target stand.

Three-dimensional (3D) archery targets in the shape of wild game animals are frequently used target practice by archers and hunters. The life-size target simulate actual situations that an archer may encounter while bowhunting. The placement of realistic appearing, life-size animal models in actual outdoor bowhunting settings is complicated by the varying slopes and terrain where an archer may wish to locate the target model.

Prior art three-dimensional animal target stands generally are fixed with respect to the surface orientation. The target stand to which the 3D animal is mounted, is intended to be set upon a flat surface to maintain the balance of the animal. However, in natural settings, flat surfaces are often unavailable, Further, wild game tend to run along hillsides when seeking cover from hunters. Thus a more realistic environment for archery target practice may include location of the 3D target on a sloped surface. Currently available target stands lack the ability to compensate for slope placement while maintaining an upright profile of the 3D animal target. The prior art models have a tendency to fall down, or to lean in an unnatural position.

What is needed is a system and/or method that satisfies one or more of these needs or provides other advantageous features. Other features and advantages will be made apparent from the present specification. The teachings disclosed extend to those embodiments that fall within the scope of the claims, regardless of whether they accomplish one or more of the aforementioned needs.

SUMMARY OF THE INVENTION

One embodiment relates to a target stand apparatus for archery. The target stand apparatus includes a pair of upright member disposed at opposing ends of a platform. Each upright member comprising a peg connected to a peg base. The peg base has an upper aperture and a pivot aperture; the peg based attached to dial plates by a pivot bolt that is inserted through the pivot aperture. The peg base is pivotable about the pivot bolt to adjust an angle of the peg relative to the platform. The dial plate has multiple apertures adjacent a peripheral edge of the dial plate, the apertures arranged to receive a locking pin. The platform has a pair of frame sections supporting the dial plate associated with the upright member. A hollow receiver portion projects perpendicular from the frame section. A connecting rod is insertable into the receiver portion on opposing ends of the connecting rod. The connecting rod is slidable within the respective receiver portion for adjusting a spacing between the pair of upright members. Each of the pegs may be inserted into a target body such that the adjusted angle of the pegs disposes the target body in a generally upright position relative to a sloped surface.

Another embodiment relates to an upright member assembly for mounting an archery target. The upright member includes a peg connected to a peg base. The peg base has an upper aperture and a pivot aperture. The peg based attached to at least one dial plate by a pivot bolt inserted through the pivot aperture. The peg base may be pivoted about the pivot bolt to adjust an angular position of the peg.

A third embodiment relates to an archery target assembly. The archery target assembly includes a pair of upright member disposed at opposing ends of a platform. Each upright member comprising a peg connected to a peg base. The peg base has an upper aperture and a pivot aperture; the peg based attached to dial plates by a pivot bolt that is inserted through the pivot aperture. The peg base is pivotable about the pivot bolt to adjust an angle of the peg relative to the platform. The dial plate has multiple apertures adjacent a peripheral edge of the dial plate, the apertures arranged to receive a locking pin. The platform has a pair of frame sections supporting the dial plate associated with the upright member. A hollow receiver portion projects perpendicular from the frame section. A connecting rod is insertable into the receiver portion on opposing ends of the connecting rod. The connecting rod is slidable within the respective receiver portion for adjusting a spacing between the pair of upright members. The target body has a pair of leg portions. The leg portions have a hollow tube for receiving one of the pair of pegs. Each of the pegs when inserted into to one of the leg portions provides an adjusted angle position to dispose the target body in a generally upright position relative to a sloped surface.

Certain advantages of the embodiments described herein include the ability to compensate for placement of a target on a stand when resting on a sloped surface, while maintaining an upright profile of the 3D animal target.

Another advantage is an adjustable connecting arm that accommodates various size targets that simulate models that are similar in size to actual game animals that an archer may encounter when bowhunting.

Another advantage is the angle may be selected to rotate the target body so that is facing the archer regardless if the archer is standing below or above the target stand, Alternative exemplary embodiments relate to other features and combinations of features as may be generally recited in the claims.

BRIEF DESCRIPTION OF THE DRAWINGS

The application will become more fully understood from the following detailed description, taken in conjunction with the accompanying figures, wherein like reference numerals refer to like elements, in which.

DETAILED DESCRIPTION OF THE INVENTION

Before turning to the figures which illustrate the exemplary embodiments in detail, it should be understood that the application is not limited to the details or methodology set forth in the following description or illustrated in the figures. It should also be understood that the phraseology and terminology employed herein is for the purpose of description only and is not to be regarded as limiting.

Figure 1:
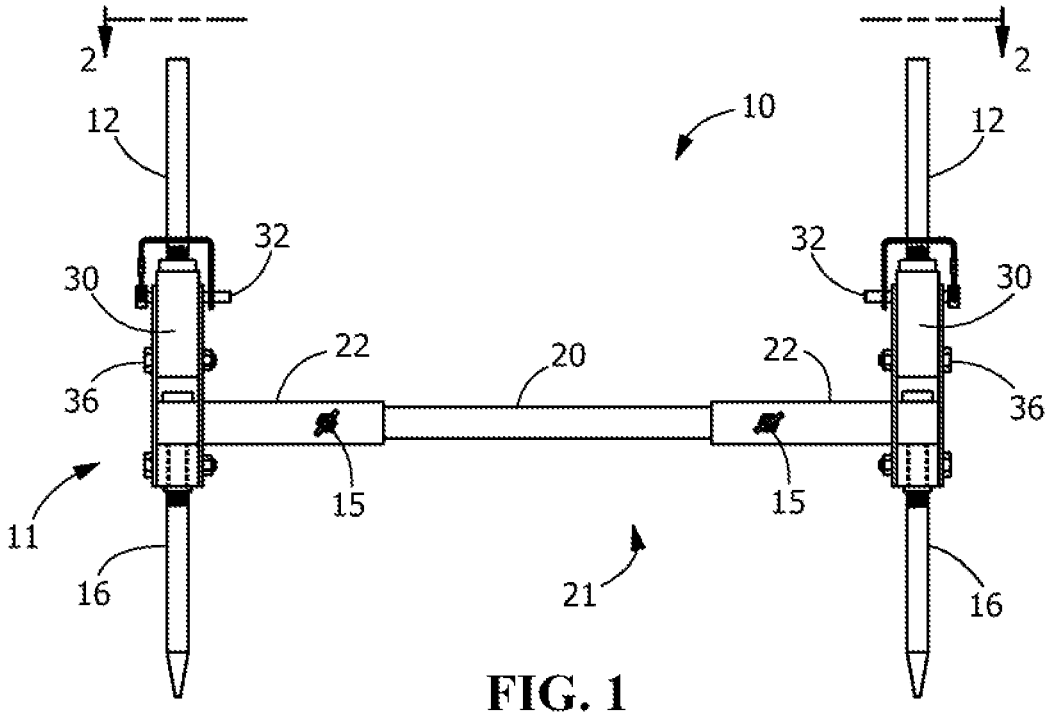
FIG. 1 shows an elevational front view of an exemplary embodiment of a three-dimensional archery target stand.

Referring to FIG. 1, show an elevational front view of one exemplary embodiment of the three-dimensional archery target stand 10. Target stand 10 includes opposing upright members 11 connected to opposite ends of a telescoping adjustment arm 21. Arm 21 has an adjustment rod 20 that is inserted into receiver portions 22. Receiver portions 22 are tubular pipe segments projecting generally perpendicularly from upright members 11, respectively. Adjustment rod 20 is slidable within receiver portions 22. The length of adjustment arm 21 is movable to suit a target body 50 (see, e.g., FIG. 7). The desired spacing is set between upright members 11, and receiver portions 22 fixed to adjustment rod 20 by one or more fasteners 15. Fasteners 15 may be, e.g., threaded thumb screws or locking pins inserted into pre-drilled apertures on rod 20.

Upright members 11 are mirror-images disposed at either end of adjustment arm 21. Each member 11 has a frame section 34 with a spike 16 extending below its respective receiver portion at either end of frame section 34. Spike 16 is chamfered to allow it to be driven into the ground for stabilizing and supporting the respective upright arm of stand 10 in a generally upright position. Spike 16 is threaded into or welded to frame section 34 extending between two spikes 16. Frame section 34 supports adjustment arm 21 and a peg base 30. Peg base 30 is described in greater detail below with respect to FIGS. 3 and 6.

Figure 2:
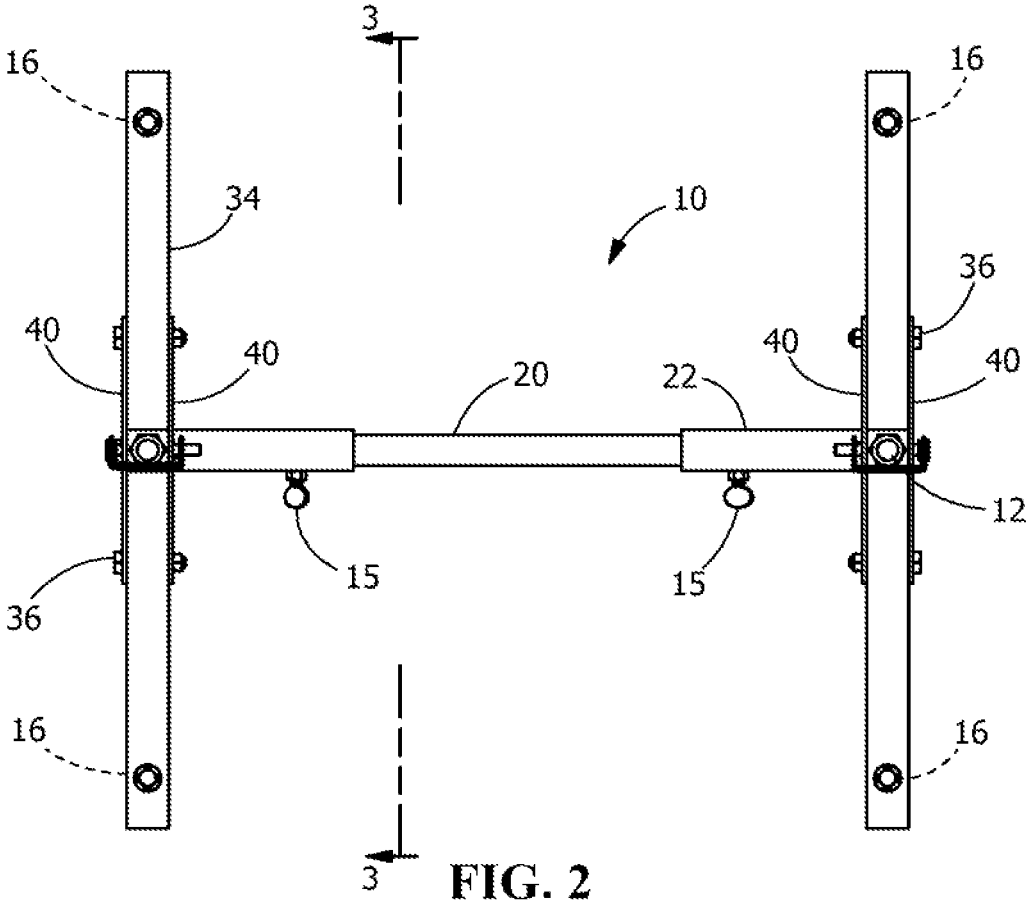
FIG. 2 shows a top plan view of the three-dimensional archery target stand of FIG. 1, taken along the lines 2-2 in FIG. 1.
Figure 7:
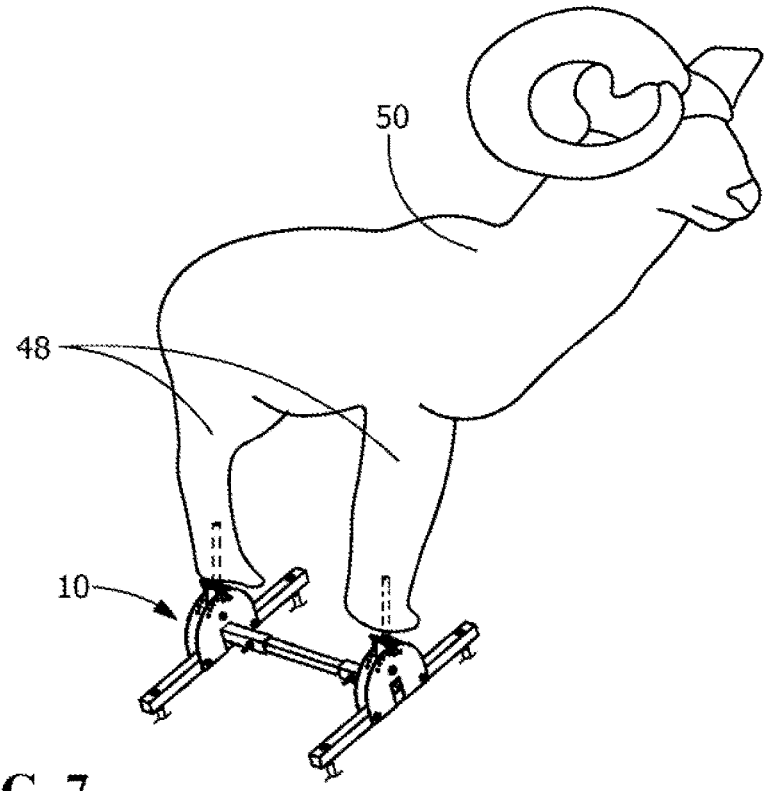
FIG. 7 shows an exemplary animal model mounted on the three-dimensional archery target stand of FIG. 1.

Referring next to FIG. 2, a top plan view of the three-dimensional archery target stand of FIG. 1, taken along the lines 2-2 in FIG. 1. Fasteners 15 are shown attached to receiver portions 22 through a threaded nut for fixing the separation distance of upright arms 11. Dial plates 40 are fastened to frame sections 34 via bolts 36. Frame sections 34 are connected via telescoping adjustment arm 21 to form an H-shaped platform 14 that supports a three-dimensional (3D) target body 50 (FIG. 7). In alternate embodiments, a platform may comprise two or adjustable arms 21 extending between frame sections 34.

Figure 3:
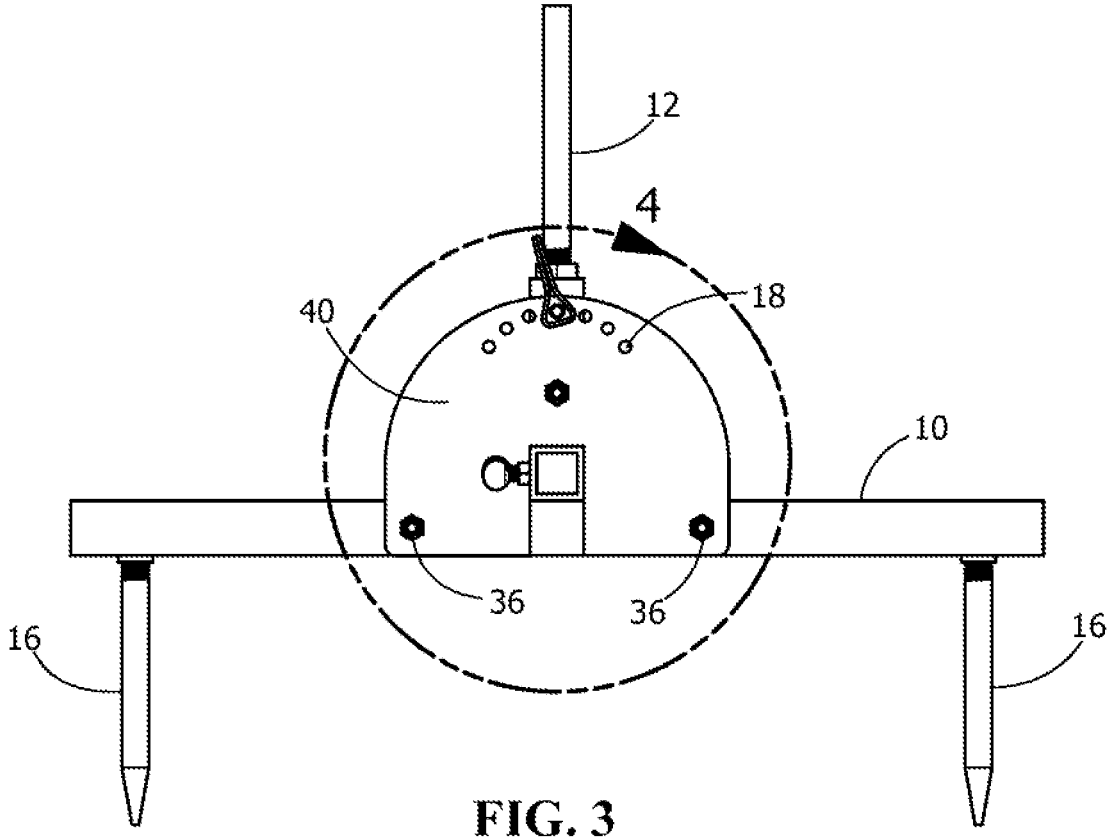
FIG. 3 shows a cross-sectional view of the three-dimensional archery target stand, taken along the lines 3-3 in FIG. 2.
Figure 4:
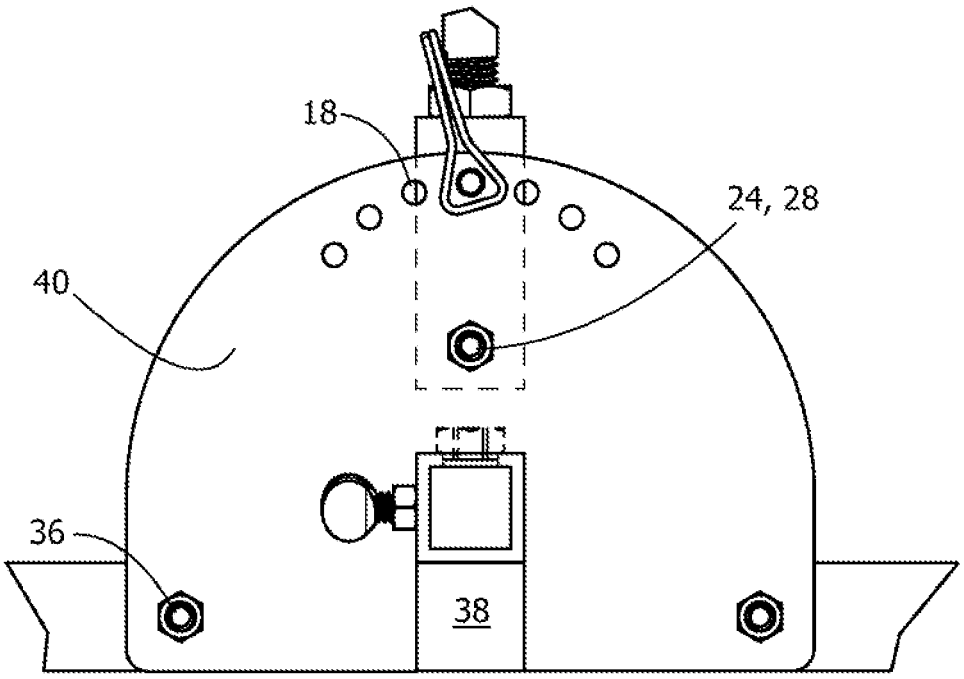
FIG. 4 shows an enlarged detail of the arcuate adjustment plate.
Figure 6:
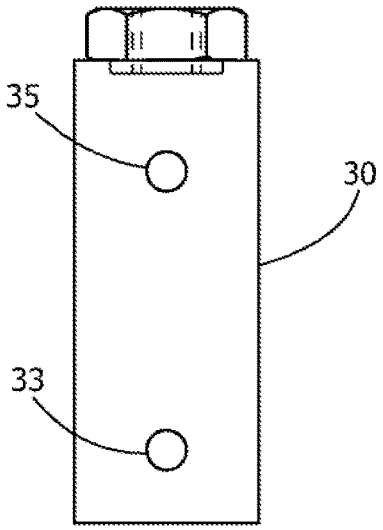
FIG. 6 shows an optional threaded glide base.

Referring next to FIGS. 3 and 6, dial plates 40 are disposed in pairs on each upright member 11. A peg 12 is disposed between plates 40. Plate 40 is semi-circular and includes apertures 18 adjacent the arcuate periphery, the apertures 18 arranged to receive a square locking pin 32, to allow rotation of pegs 12 at a selected angular positions from vertical. In an embodiment plate 40 has apertures 18 at seven angles between +/−34° at 18° to 20° intervals, e.g., 52°, 70° and 90°, as shown in FIG. 4. In alternate embodiment the number and spacing of apertures may vary to suit specific environmental conditions associated with bowhunting. A pivot aperture 24 in plate 40 provide a fixed pivot point about which peg base and pegs rotate. In an embodiment, peg base 30 may include a ½" (1.27 cm)-13 welded nut inside a distal end. The peg 12 may be inserted in the top of female receiver 22 when dial plates are not being used.

Pegs 12 are attached to a peg base 30, and peg base 30 is disposed between a pair of plates 40 (see, e.g., FIG. 1 and FIG. 6). Peg base 30 is rotatably attached to plates 40 and lockable inside dial plates to set pegs 12 at one of the predetermined angles of the respective apertures 18. Peg base 30 includes an upper aperture 35 and a lower aperture 33. A pivot bolt 28 is inserted through lower aperture 33, in alignment with pivot aperture 24, to provide an axis for rotation of peg base 30. Plates 40 include a notch 38 that fits over ends of receiver portions 22. In an exemplary embodiment, pegs 12 and spike may have threaded ends of ½ inch (1.27 cm)-13 threads for connection with a welded internally threaded coupling nut on the respective base and frame sections.

Figure 5:
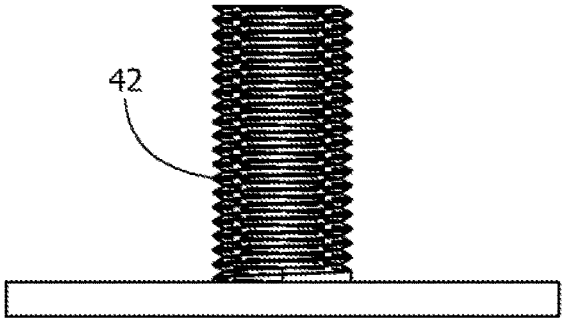
FIG. 5 shows an exemplary peg base.

Referring next to FIG. 5, in an alternate embodiment a steel glide 42 may be used in place of the spike 16 for placement of target stand 10 on a hard, flat surface, e.g., indoor target ranges, or on a level field. Steel glide 42 threads into the ends of frame section 34 with an internal coupling nut (not shown), or similar internally threaded annulus. In an exemplary embodiment glides 42 may be substituted for spikes 16 when stand 10 is used indoors or on any surface other than on the ground or on soil.

Referring next to FIG. 7, an exemplary target body 50 is shown placed on the target stand 10 as the stand may be used on a hillside. In FIG. 7 target body 50 simulates a game sheep, but the target body may be shaped like various game animals hunted by archers. As can be seen, the spacing of the targets legs 48 correspond with the length setting between upright members 11 after adjusting the length of adjustment arm 21. Legs 48 may be arranged with an annular vertical tube (not shown) that slips over pegs 12. By rotating the peg base 30, target body 50 may be tilted relative to frame 10 to appear to an archer to be standing upright on a sloped surface. Depending on whether the archer is standing below or above the target stand, the angle may be selected to rotate the target body so that the side of the target body is facing the archer, thus simulating a realistic bowhunting setting.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

It is important to note that the construction and arrangement of the 3D target stand as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

The invention claimed is:

1. A target stand apparatus for archery, comprising:

a pair of upright members disposed at opposing ends of an H-shaped platform;

each upright member comprising a peg connected to a peg base;

each peg base comprising an upper aperture and a pivot aperture; each peg base attached to at least one dial plate by a pivot bolt inserted through the pivot aperture;

each peg base pivotable about the pivot bolt to adjust an angle of the peg relative to the platform;

each dial plate including at least two apertures adjacent a peripheral edge of the dial plate and arranged for receiving a locking pin;

the platform comprising a pair of frame sections supporting the dial plate associated with each upright member;

a hollow receiver portion projecting perpendicular to the frame sections to form the H-shaped platform;

a connecting rod insertable into each receiver portion on opposing ends of the connecting rod; the connecting rod slidable within the respective receiver portion for adjusting a spacing between the pair of upright members;

wherein each of the pegs being insertable to a target body such that the adjusted angle of the pegs disposes the target body in a generally upright position relative to a sloped surface.

2. The target stand apparatus of claim 1, the platform shape comprising opposing frame sections connected at respective mid-points by the connecting rod and the opposing receiver portions.

3. The target stand apparatus of claim 2, each receiver portion further comprising a fastener for fixing a length of the connecting rod.

4. The target stand apparatus of claim 1, wherein the platform further comprises a pair of stakes projecting perpendicular from opposing ends of each frame section; the stakes having a chamfered distal point that is penetrable into a ground surface suitable for stabilizing the target stand.

5. The target stand apparatus of claim 4, wherein each receiver portion further comprises a pre-drilled and threaded aperture for receiving one of a thumb screw or locking pin members; and wherein the connecting rod is lockable at a predetermined length when said thumb screw or locking pin members is inserted in the receiving portion.

6. The target stand apparatus of claim 1, wherein the dial plates are disposed in pairs on opposing sides of each frame section.

7. The target stand apparatus of claim 6, wherein each peg base and respective peg is disposed between the pair of dial plates at opposing ends of each frame section.

8. The target stand apparatus of claim 1, wherein each dial plate is semi-circular and includes a plurality of apertures adjacent an arcuate periphery of the dial plate, the plurality of dial plate apertures arranged to allow rotation of the peg at predetermined angular positions relative to the platform.

9. The target stand apparatus of claim 8, wherein the dial plate apertures are arranged at seven discrete angles spaced from 18° to 20° intervals plus or minus 34°, relative to the platform.

10. The target stand apparatus of claim 8, wherein the dial plate further comprises a pivot aperture defining a fixed pivot point about which each peg base and respective peg rotate.

11. An archery target assembly comprising:

a target stand apparatus for archery, comprising:

a pair of upright members disposed at opposing ends of an H-shaped platform;

each upright member comprising a peg connected to a peg base;

each peg base comprising an upper aperture and a pivot aperture; each peg base attached to at least one dial plate by a pivot bolt inserted through the pivot aperture;

each peg base pivotable about the pivot bolt to adjust an angle of the peg relative to the platform;

each dial plate including at least two apertures adjacent a peripheral edge of the dial plate and arranged for receiving a locking pin; the platform comprising a pair of frame sections supporting the dial plate associated with each upright member;

a hollow receiver portion projecting perpendicular to each frame section to form the H-shaped platform;

a connecting rod insertable into each receiver portion on opposing ends of the connecting rod; the connecting rod slidable within the respective receiver portion for adjusting a spacing between the pair of upright members; and a target body having a pair of leg portions, the leg portions having a hollow tube for receiving one of the pair of pegs;

wherein each of the pegs when inserted into to one of the leg portions provides an adjusted angle position to dispose the target body in a generally upright position relative to a sloped surface.

12. The archery target assembly of claim 11, the platform shape comprising opposing frame sections connected at respective mid-points by the connecting rod and the opposing receiver portions.

13. The archery target assembly of claim 12, each receiver portion further comprising a fastener for fixing a length of the connecting rod.

14. The archery target assembly of claim 11, wherein the platform further comprises a pair of stakes projecting perpendicular from opposing ends of each frame section; the stakes having a chamfered distal point that is penetrable into a ground surface suitable for stabilizing the target stand.

15. The archery target assembly of claim 14, wherein each receiver portion further comprises a pre-drilled and threaded aperture for receiving one of a thumb screw or locking pin members; and wherein the connecting rod is lockable at a predetermined length when said thumb screw or locking pin members is inserted in the receiving portion.

16. The archery target assembly of claim 11, wherein the dial plates are disposed in pairs on opposing sides of each frame section.

17. The archery target assembly of claim 16, wherein each peg base and respective peg is disposed between the pair of dial plates at opposing ends of each frame section.

18. The archery target assembly of claim 11, wherein each dial plate is semi-circular and includes a plurality of apertures adjacent an arcuate periphery of the dial plate, the plurality of dial plate apertures arranged to allow rotation of the peg at predetermined angular positions relative to the platform.

19. The archery target assembly of claim 18, wherein the dial plate apertures are arranged at seven discrete angles spaced from 18° to 20° intervals plus or minus 34°, relative to the platform.

20. The archery target assembly of claim 18, wherein each dial plate further comprises a pivot aperture defining a fixed pivot point about which each peg base and respective peg rotate.

* * * * *